US008381833B2

(12) United States Patent
Bernardi

(10) Patent No.: US 8,381,833 B2
(45) Date of Patent: Feb. 26, 2013

(54) COUNTERBALANCE FOR ECCENTRIC SHAFTS

(75) Inventor: Walter M. Bernardi, Highland Park, IL (US)

(73) Assignee: Robert Bosch GmbH, Stuttgart (DE)

( * ) Notice: Subject to any disclaimer, the term of this patent is extended or adjusted under 35 U.S.C. 154(b) by 194 days.

(21) Appl. No.: 12/566,442

(22) Filed: Sep. 24, 2009

(65) Prior Publication Data

US 2011/0067894 A1 Mar. 24, 2011

(51) Int. Cl.
*B25D 17/24* (2006.01)

(52) U.S. Cl. ..... 173/162.1; 173/217; 173/49

(58) Field of Classification Search ..... 173/162.1, 173/216–218, 49, 213
See application file for complete search history.

(56) References Cited

U.S. PATENT DOCUMENTS

| | | | | |
|---|---|---|---|---|
| 3,305,031 | A | 2/1967 | Bez et al. | |
| 3,482,362 | A | 12/1969 | Bangerter et al. | |
| 4,854,085 | A * | 8/1989 | Huber | 451/357 |
| 5,681,213 | A * | 10/1997 | Hashii | 451/356 |
| 5,685,615 | A | 11/1997 | Bechem et al. | |
| 5,919,085 | A * | 7/1999 | Izumisawa | 451/357 |
| 6,206,771 | B1 * | 3/2001 | Lehman | 451/357 |
| 6,413,157 | B1 * | 7/2002 | Marton | 451/357 |
| 6,913,528 | B2 | 7/2005 | Schulz et al. | |
| 6,926,595 | B2 * | 8/2005 | Pollak et al. | 451/270 |
| 6,942,558 | B2 | 9/2005 | Wuensch | |
| 6,974,362 | B2 * | 12/2005 | Lindell et al. | 451/5 |
| 7,022,002 | B2 * | 4/2006 | Lampka et al. | 451/344 |
| 7,104,873 | B1 * | 9/2006 | Borinato et al. | 451/159 |
| 7,108,077 | B2 * | 9/2006 | Zaiser | 173/48 |
| 7,153,199 | B1 * | 12/2006 | Decker | 451/343 |
| 7,363,713 | B2 | 4/2008 | Hirabayashi et al. | |
| 2006/0116058 | A1 | 6/2006 | Bosten et al. | |

* cited by examiner

*Primary Examiner* — Rinaldi Rada
*Assistant Examiner* — Andrew M Tecco
(74) *Attorney, Agent, or Firm* — Maginot, Moore & Beck

(57) ABSTRACT

A power tool includes a housing, a motor having a motor output shaft and located within the housing, the motor being configured to rotate the motor output shaft about a first axis, a drive component having (i) a body attached to the motor output shaft, and (ii) an output drive pin attached to the body, the output drive pin defining a second axis which is offset from the first axis, the body being caused to rotate about the first axis in response to rotation of the motor output shaft about the first axis, and the output drive pin being caused to be eccentrically driven in response to rotation of the body about the first axis, and further the body having a hub and a counterbalance arrangement attached to the hub, the counterbalance arrangement being positioned and configured to offset forces generated by the output drive pin when eccentrically driven, a linkage configured to oscillate in response to the output drive pin being eccentrically driven, and a tool mount configured to oscillate in response to oscillation of the linkage.

10 Claims, 10 Drawing Sheets

COUNTERBALANCE FOR ECCENTRIC SHAFTS

FIELD OF THE INVENTION

The apparatuses described in this document relate to powered tools and, more particularly, to handheld powered tools.

BACKGROUND OF THE INVENTION

Handheld power tools are well-known. These tools typically include an electric motor having an output shaft that is coupled to a tool mount for holding a tool. The tool may be a sanding disc, a de-burring implement, cutting blade, or the like.

Electrical power is supplied to the electric motor from a power source. The power source may be a battery source such as a Ni-Cad, Lithium Ion, or an alternating current source, such as power from a wall outlet.

The power source is coupled to the electric motor through a power switch. The switch includes input electrical contacts for coupling the switch to the power source and a moveable member for closing the input electrical contacts. The moveable member is biased so that the biasing force returns the moveable member to the position where the input electrical contacts are open when the moveable member is released.

Closure of the input electrical contacts causes electrical current to flow through the motor coils, which causes the motor armature to rotate about the coils. A speed control is usually provided on these power tools to govern the electrical current that flows through the motor.

Typically power tools are designed for one function. Some power tools may provide one or two utilities, such as a power drill used as a power screwdriver. However, generally different power tools are needed for different applications. For example, typically a power sander is not well suited to cut a pipe. In recent years some tool manufactures have provided a pseudo-universal power tool for a variety of applications. Many of these tools operate on the basis of converting rotational movement of the motor to an oscillating motion by a tool mount to which a tool is attached. However, even without the power tool engaging a workpiece, the vibration resulting from the oscillation is annoying and uncomfortable for the user of the tool.

Therefore, a pseudo-universal power tool is need that reduces or eliminates vibration transferred from the tool to the user of the tool.

SUMMARY OF THE INVENTION

According to one embodiment of the present disclosure, there is provided a power tool which includes a housing, a motor having a motor output shaft and located within the housing, the motor being configured to rotate the motor output shaft about a first axis, a drive component having (i) a body attached to the motor output shaft, and (ii) an output drive pin attached to the body, the output drive pin defining a second axis which is offset from the first axis, the body being caused to rotate about the first axis in response to rotation of the motor output shaft about the first axis, and the output drive pin being caused to be eccentrically driven in response to rotation of the body about the first axis, and further the body having a hub and a counterbalance arrangement attached to the hub, the counterbalance arrangement being positioned and configured to offset forces generated by the output drive pin when eccentrically driven, a linkage configured to oscillate in response to the output drive pin being eccentrically driven, and a tool mount configured to oscillate in response to oscillation of the linkage.

According to another embodiment of the present disclosure, there is provided a method for oscillating a tool that includes rotating a motor output shaft of a motor about a first axis, rotating a body of a drive component about the first axis in response to rotation of the motor output shaft, the body having a hub and a counterbalance arrangement, eccentrically driving an output drive pin of the drive component in response to rotation of the body, the output drive pin defining a second axis which is offset from the first axis, oscillating a linkage in response to eccentrically driving the output drive pin, oscillating a tool mount in response to oscillating the linkage, and oscillating a tool in response to oscillating the tool mount.

BRIEF DESCRIPTION OF THE DRAWINGS

The present invention may take form in various system and method components and arrangement of system and method components. The drawings are only provided for purposes of illustrating exemplary embodiments and are not to be construed as limiting the invention.

DESCRIPTION

Figure 1:
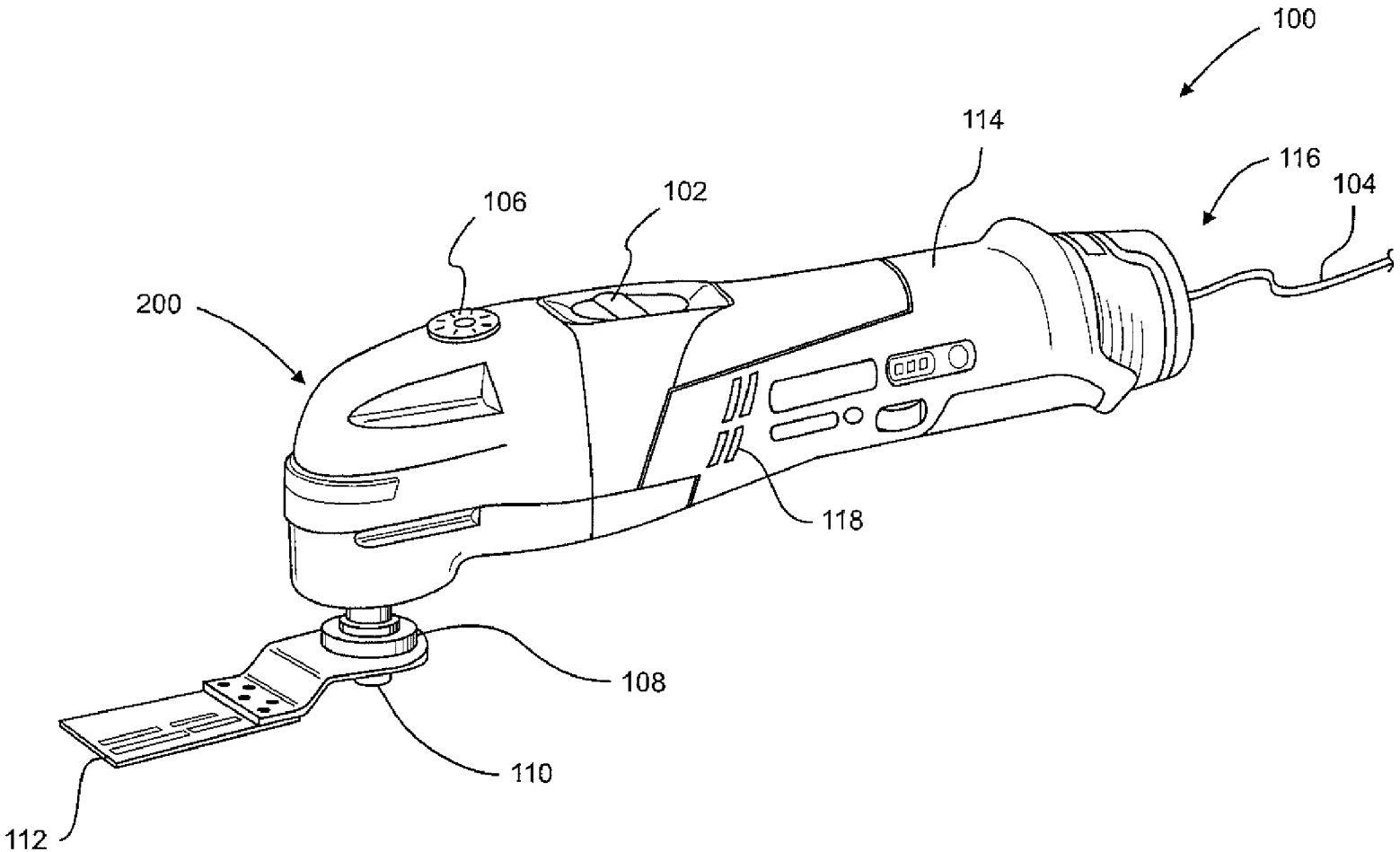
FIG. 1 depicts a perspective view of a power tool incorporating features of the current teachings.

A power tool generally designated 100 is shown in FIG. 1. In the embodiment of FIG. 1, the power tool 100 includes a housing 114, a power cord 104 that enters the power tool 100 at a tail portion 116, a power switch 102, a variable speed control dial 106, a head portion 200, a tool mount 108, and a tool mount fastener 110. The tool mount fastener 110 attaches a tool 112 to the tool mount 108. The tool 112 depicted in the embodiment of FIG. 1 is a cutting tool for cutting various structures, such as plywood, paneling, etc. In one embodiment, the power switch 102 can be integrated with the variable speed control dial 106. The housing 114 is made from a hard plastic to make the power tool 100 into a rugged tool. Also, shown in FIG. 1 are vent slots 118, defined in the housing 114. In one embodiment, the power tool 100 is battery operated in which case the power cord 104 is eliminated, and the power tool includes a battery (not shown) for supplying electric power to operate the tool 100.

The power tool 100 is operated by pressing on the power switch 102. In one embodiment, by pressing down on the power switch 102 or by sliding the power switch 102 forward, the power switch 102 engages contacts (not shown). In the embodiment where the power switch 102 is also the variable speed control dial 106, moving the power switch 102 forward to different positions causes the power tool 100 to operate at different speeds.

Figure 2:
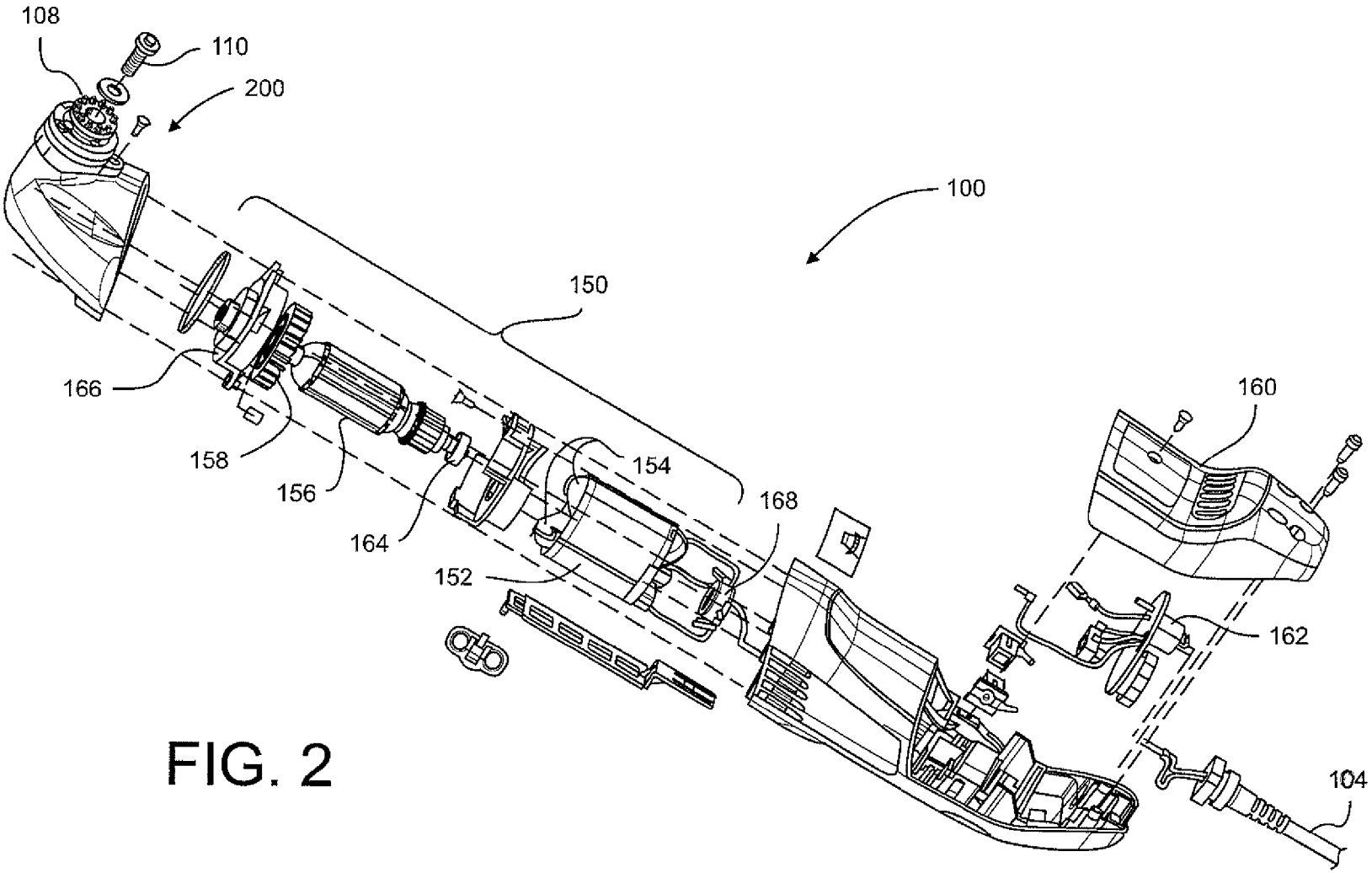
FIG. 2 depicts an exploded perspective view of the power tool of FIG. 1 with an electrical cover and a motor cover portions of a housing broken away to reveal various features of the power tool.

Referring to FIG. 2, an exploded view of the power tool 100 is provided depicting various internal components. The electrical housing 160 portion of the housing 114 is lifted to reveal termination of the power cord 104 at a power junction assembly 162 for distributing the power to various components downstream from the tail portion 116 of the power tool 100. Also depicted in FIG. 2 is a motor assembly 150 which includes a coil housing 152, coils 154, armature 156, and a fan blade 158. The fan blade 158 is positioned proximate to the vent slots 118 for recirculating air near and around the armature 156 and coils 154. The head portion 200 depicts the tool mount 108 and the tool mount fastener 110 for mounting the tool (see FIG. 1). Also depicted in FIG. 2 are a motor mount 168, a motor bearing 164, and a motor bearing structure 166.

The armature 156 is placed inside the coil housing 152 and is caused to turn as magnetic fields are generated by the coils 154. Various components of the motor assembly 150 are mounted between the motor mount 168 and the motor bearing structure 166, which also provides a bearing function for a motor output shaft (not shown in FIG. 2). One end of the armature is terminated at a motor bearing 164 which is received in the motor mount 168. The motor bearing structure 166 is mounted to an inside surface of a housing portion of the head portion 200 to securely suspend the motor assembly 150.

Figure 3:
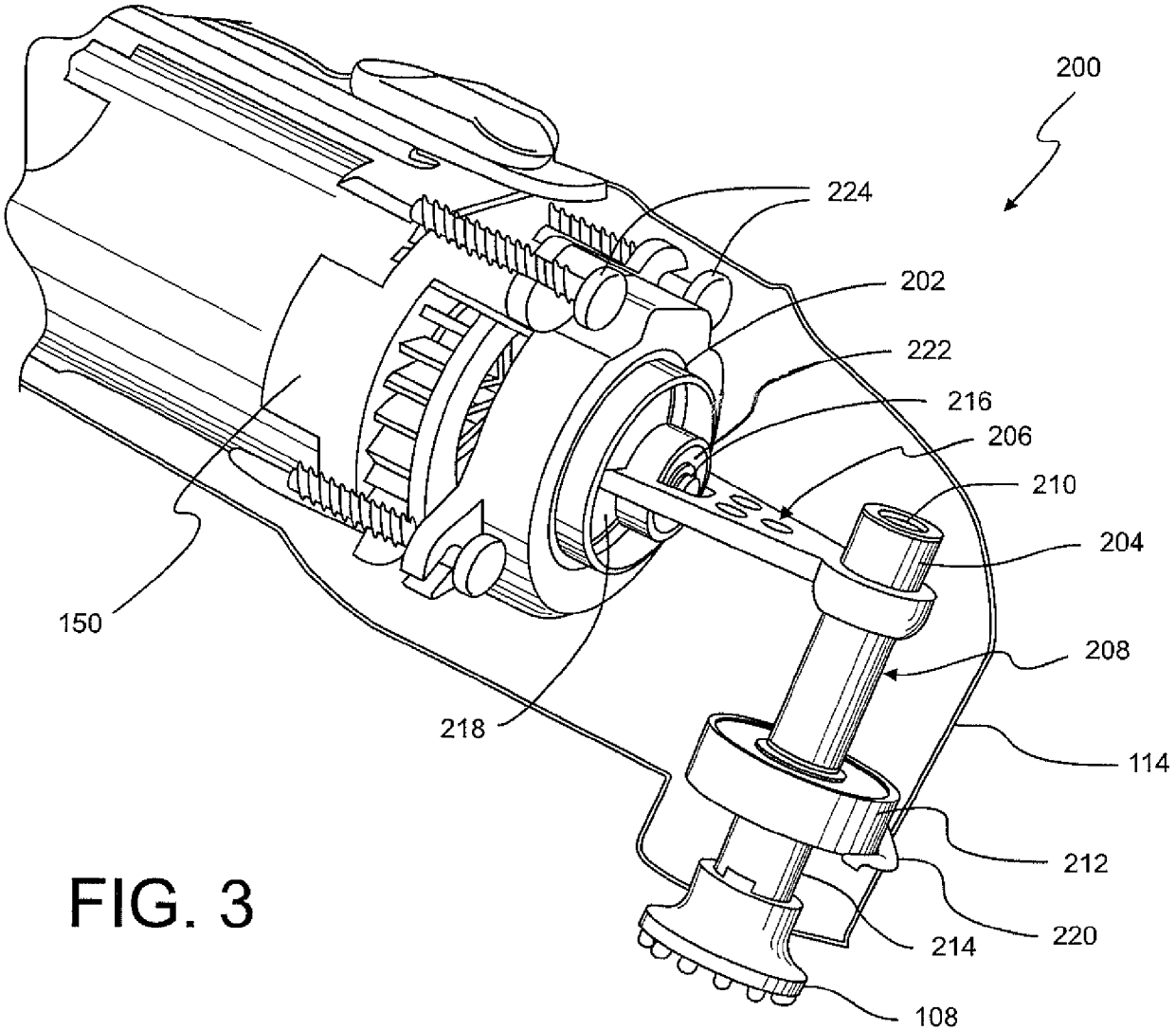
FIG. 3 depicts a perspective view of a head portion of the power tool of FIG. 1 with various internal features revealed through a portion of the housing covering the head portion.
Figure 4:
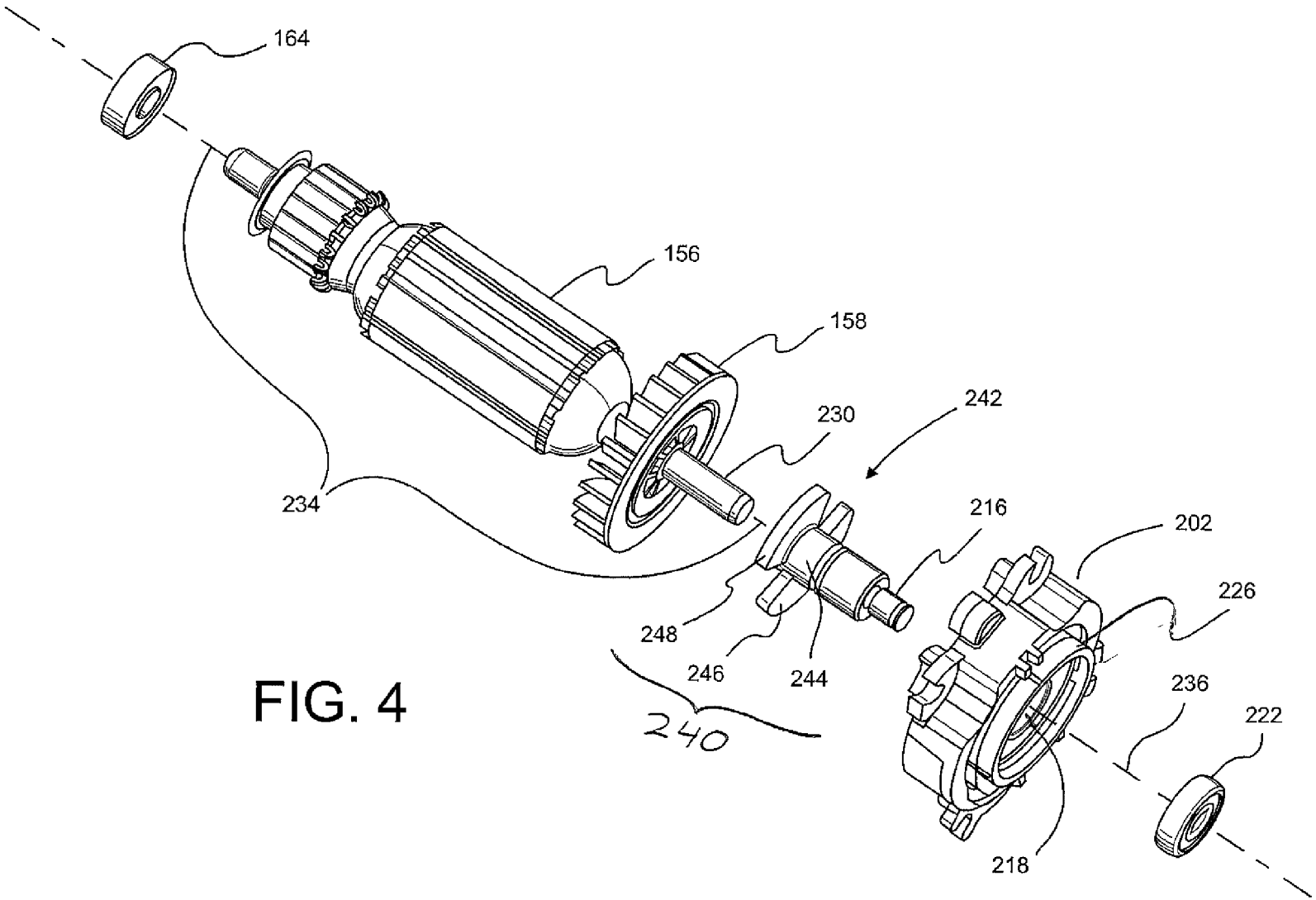
FIG. 4 is an exploded perspective view of an armature, a drive component, a drive bearing, a bearing, and a drive bearing of the power tool of FIG. 1.

Referring to FIGS. 3-4, the head portion 200 of the power tool 100 is depicted with various internal components revealed under the housing. Shown in FIG. 3 are the motor assembly 150, a bearing structure 202, a bearing 204, an input link 206, an output link 208, a top portion of the output link 210, a bearing 212, a bottom portion of the output link 214, an output drive pin 216, a bearing 218 which is part of the bearing structure 202, a retaining ring 220, and a drive bearing 222. Shown in FIG. 4 is an exploded view of components that partially make up the head portion 200 of the power tool 100, which include a motor output shaft 230, a drive bearing 222, a drive component 240, a hub 244, and a counterbalance arrangement 242 which includes a counterbalance structure 246 and a counterbalance structure 248. Depicted in FIG. 4 are also a first axis 234 and a second axis 236. The drive bearing 222 has an interior bearing surface and an exterior surface. The interior bearing surface of the drive bearing 222 interfaces with the output drive pin 216 while the exterior surface of the drive bearing 222 interfaces with the input link 206. The top portion 210 of the output link 208 interfaces with the input link 206 and the bearing 204. The bottom portion 214 of the output link 208 interfaces with the bearing 212 and the tool mount 108. The bearing structure 202 is attached to the motor assembly 150 by fasteners 224.

The output drive pin 216 is part of the drive component 240. The drive component 240 may interface with the motor output drive shaft 230 in a frictional fit manner or by using fasteners such as pins, screws, etc. The motor output drive shaft 230 rotates about the first axis 234 which causes the drive component 240 to rotate about the first axis 234.

The output drive pin 216 defines the second axis 236 which passes through the center of the output drive pin 216. The second axis 236 is offset from the first axis 234, as will be discussed in greater detail with reference to FIGS. 5-6. Rotation of the motor output shaft 230 results in the output drive pin 216 and the second axis 236 to be driven eccentrically about the first axis 234. The drive bearing 222 which is mounted on the output drive pin 216 is, therefore, also driven eccentrically.

The bearing structure 202 includes a bearing 218 which interfaces with a hub 244 of the drive component 240. The eccentrically driven drive bearing 222 moves inside a flange 226 of the bearing structure 202. Therefore, the flange 226 has a sufficiently large inner diameter to prevent any interference with the eccentrically driven drive bearing 222.

Figure 5:
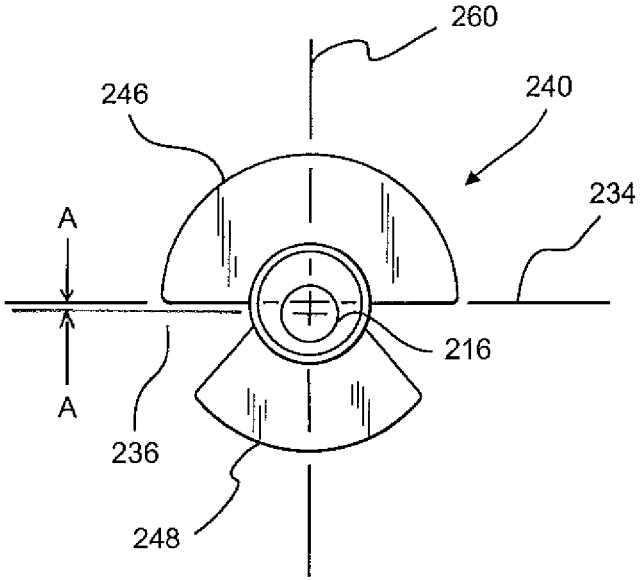
FIG. 5 is a front view of the drive component of the power tool of FIG. 1 depicting a counterbalance arrangement and an output drive pin.
Figure 6:
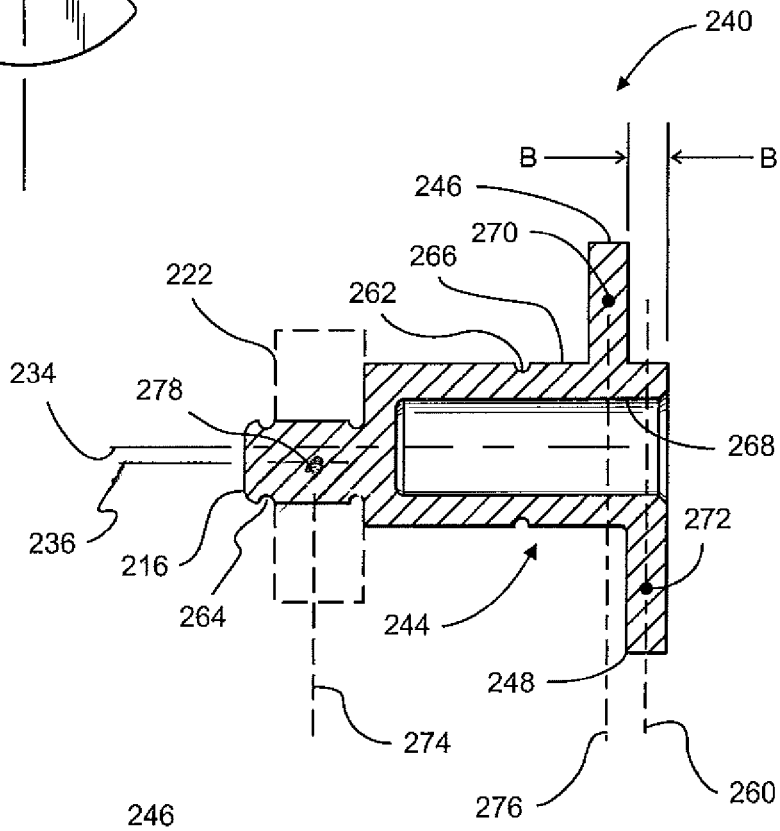
FIG. 6 is a cross sectional view of the drive component of the power tool of FIG. 1 depicting a body including a hub, a counterbalance structure, another counterbalance structure, a bore, and two retainer grooves.
Figure 7:
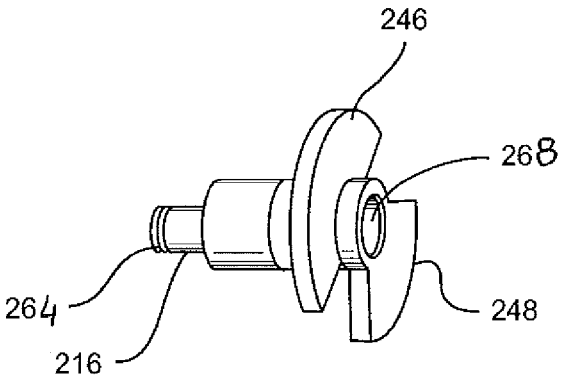
FIG. 7 is a perspective view of the drive component of the power tool of FIG. 1.

Referring to FIGS. 5-7 the drive component 240 is depicted. Particularly, FIG. 5 depicts a front view of the drive component 240. As discussed above, the output drive pin 216 has an offset between the second axis 236 and the first axis 234 which is shown by the reference A-A. The counterbalance structure 246 of the counterbalance arrangement 242 is shown to have a span of about 180°, while the counterbalance structure 248 is shown to have a smaller radial span of about 120°.

FIGS. 6-7 depict a cross-sectional view and a perspective view of the drive component 240. The counterbalance structures 246 and 248 are axially separated by the distance referenced as BB. The bearing 218 of the bearing structure 202 fits over the hub 244 in a frictional fit manner or by a set screw or other means known to those skilled in the art. A retainer ring groove 262 receives a retainer ring (not shown) to secure the bearing 218 from sliding out. Similarly, the drive bearing 222 fits on to the drive pin 216 in a frictional fit manner and is secured from sliding out by a retaining ring (not shown) that is received in the retaining ring groove 264. As discussed above, the bore 268 receives the motor output drive shaft 230.

Provided below are mathematical formulas that can be used by a person skilled in the art for deriving various parameters associated with the drive component 240. The formulas provided below assume an unbalance mass of only the drive bearing 222 and drive pin 216. Other components, such as the input link 206, etc., may also add unbalances which will need to be taken into account in order to completely balance the drive component 240. All radial measurements are referenced against the first axis 234 while all axial measurements are referenced against a plane 260 which longitudinally crosses a center of gravity 272 of the counterbalance structure 248. Therefore, while the counterbalance structure 248 has a zero axial distance from the plane 260, the center of gravity 272 has a radial distance of R3 from the first axis 234. A center of gravity 270 of the counterbalance structure 246 lies on a plane 276 which has a distance of X2 from the plane 260 and a radial distance of R2 from the first axis 234. Similarly, the drive bearing 222 and the output drive pin 216 collectively have a center of gravity 278 which lies on a plane 274 which has an axial distance of X1 away from the plane 260. In one embodiment, the center of gravity 278, lies on the second axis 236 and has a radial distance R1 from the first axis 234 (identified as AA in FIG. 5). The center of gravity 278 has a mass of M1, the center of gravity 270 has a mass of M2, and the center of gravity 272 has a mass of M3. The mass M1 includes the mass of the drive baring 222 and the mass of the drive pin 216. Both of these masses lie on the same axis 236. The bending moment formula, which is $M*R*\omega^2*X$, is used to determine certain parameters. In this formula, R is the radial distance from the first axis 234, X is the axial distance from the plane 260, and w is rotational speed. The bending moments of M1 and M2 can be cancelled out by letting $$M1*R1*X1*\omega^2+M2*R2*X2*\omega^2=0$$

Since M1, R1, and X1 are known, using existing design constraints, a value for R2 and X2 can be chosen which by applying to the above formula can produce the value for M2, as provided below:

$$M2=\frac{M1R1X1}{R2X2}$$

Similarly, centrifugal forces about the first axis 234 can be cancelled out by:

$$M1*R1*\omega^2+M3*R3*\omega^2-M2*R2*\omega^2=0$$

Since M1, R1, X1, M2, R2, and X2 are known, using existing design constraints, a value for R3 can be chosen which by applying to the above formula can produce the value for M3, as provided below:

$$M3=\frac{M1R1-M2R2}{R3}$$

As discussed above, a more detailed mathematical analysis, as known to one skilled in the art, similar to the analysis provided above is needed to account for the imbalances introduced by the input link 206, the output link 208, etc. In one embodiment, the second axis 236 is offset from the first axis 234 by a distance of between about 0.025 inches to about 0.045 inches. In one embodiment, the counterbalance structure 246 has a mass of between about 2.7 grams and about 5.1 grams. In one embodiment, the counterbalance structure 248 has a mass of between about 1.7 grams and about 3.2 grams.

Figure 8:
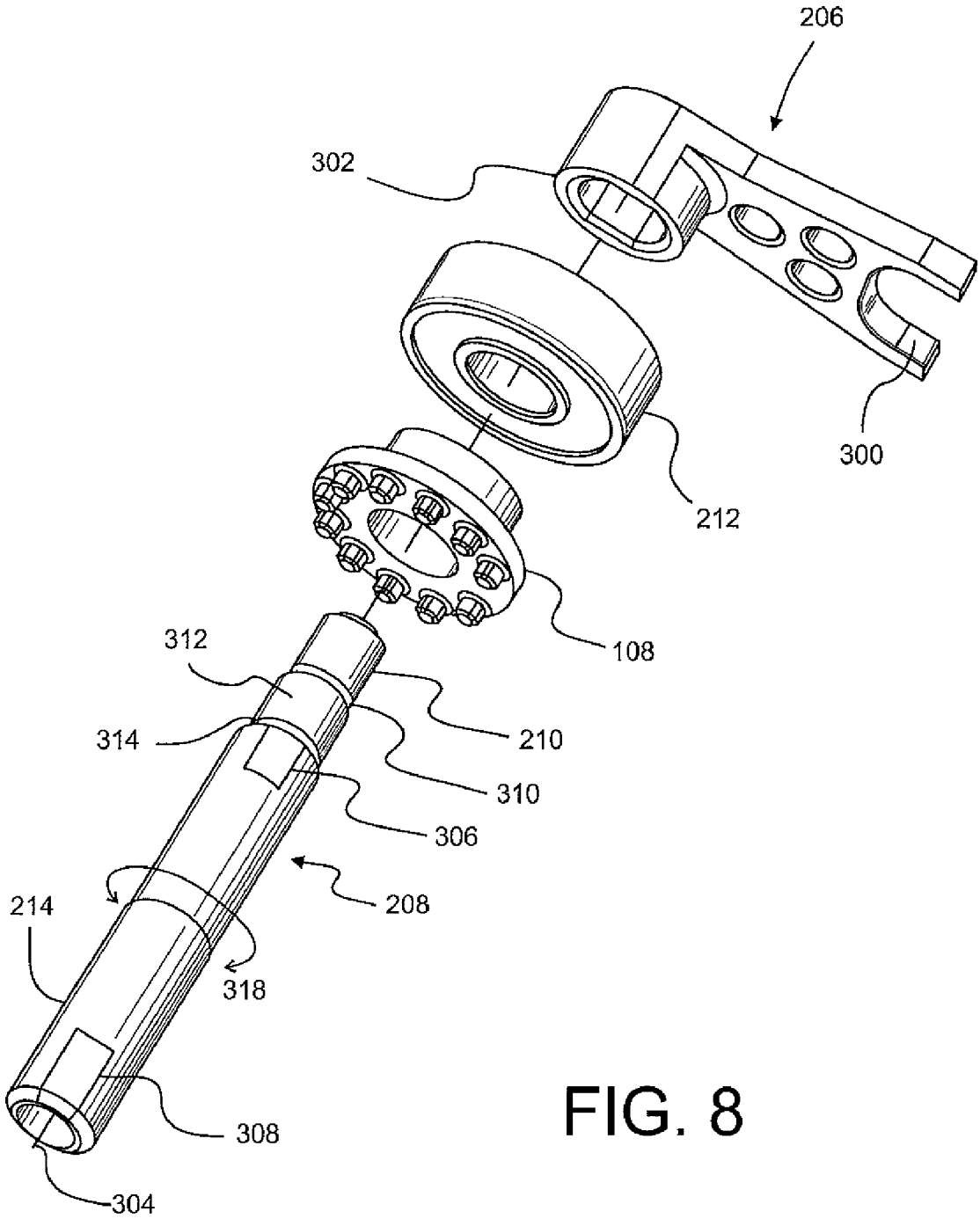
FIG. 8 is an exploded view of various components of the power tool of FIG. 1 that partially make up the head portion of the tool including an input link, an output link, a bearing structure, and a tool mount.

Referring to FIG. 8, an exploded perspective view of some of the components that make up the head portion 200 is depicted. Shown in FIG. 8 are the input link 206, the output link 208, the top portion 210 of the output link 208, the bottom portion 214 of the output link 208, a bearing surface 300 of the input link 206, a collar 302 of the input link 206, the bearing 212, the tool mount 108, chamfers 310 and 314 of the output link 208, a shaft portion 312 of the output link 208, key slots 306 and 308 of the output link 208, an axis 304, and a direction of rotational oscillation 318 of the output link 208 about the axis 304. As discussed above, the exterior surface of the drive bearing 222 interfaces with the input link 206 at the bearing surface 300. The interface can be a frictional fit type or the bearing surface 300 can be secured by way of set screws and other fasteners well known to those skilled in the art. Details of the input link 206 are provided in reference to FIGS. 9-10, below. The key slot 306 of the output link 208 aligns with a key slot 354 (See FIG. 10), while the shaft portion 312 and the top portion 210 of the output link 208 slide through the collar 302 of the input link 206. A key (not shown) can secure the interface between the output link 208 and the input link 206. The bearing 212 couples with the output link 206 at the bottom portion 214 in a frictional fit manner, or by using a fastener as is well known to those skilled in the art. The key slot 308 aligns with a key slot (not shown) on the tool mount 108 and a key (not shown) can secure the interface between the output link 208 and the tool mount 108.

Figure 9:
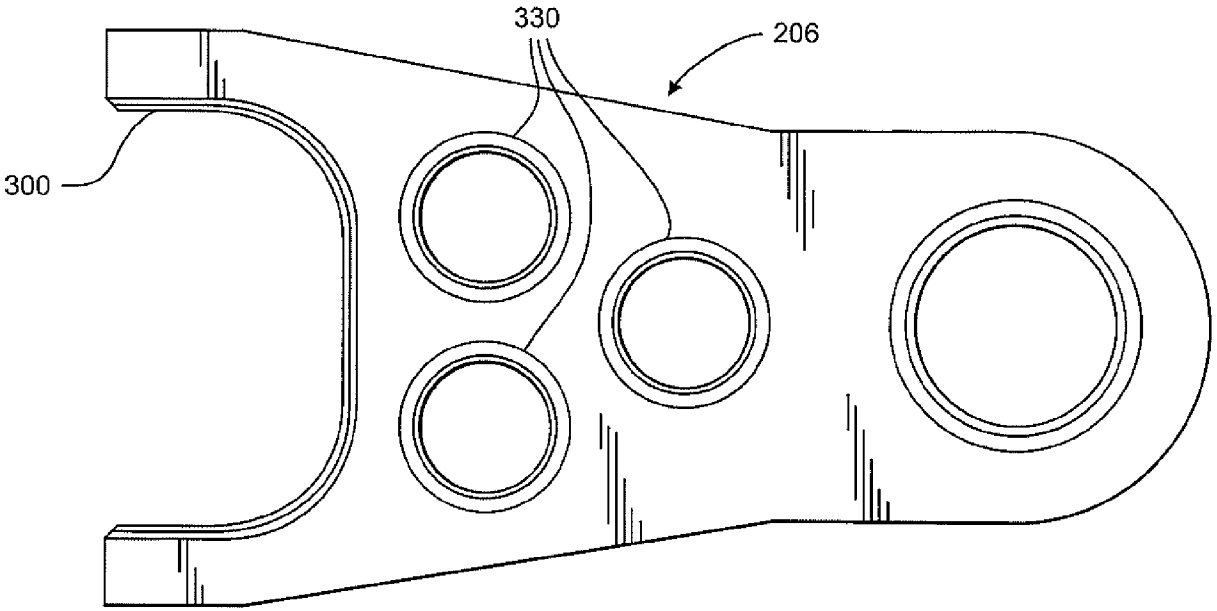
FIG. 9 is a top view of the input link of the power tool of FIG. 1, depicting among other features a bearing surface.
Figure 10:
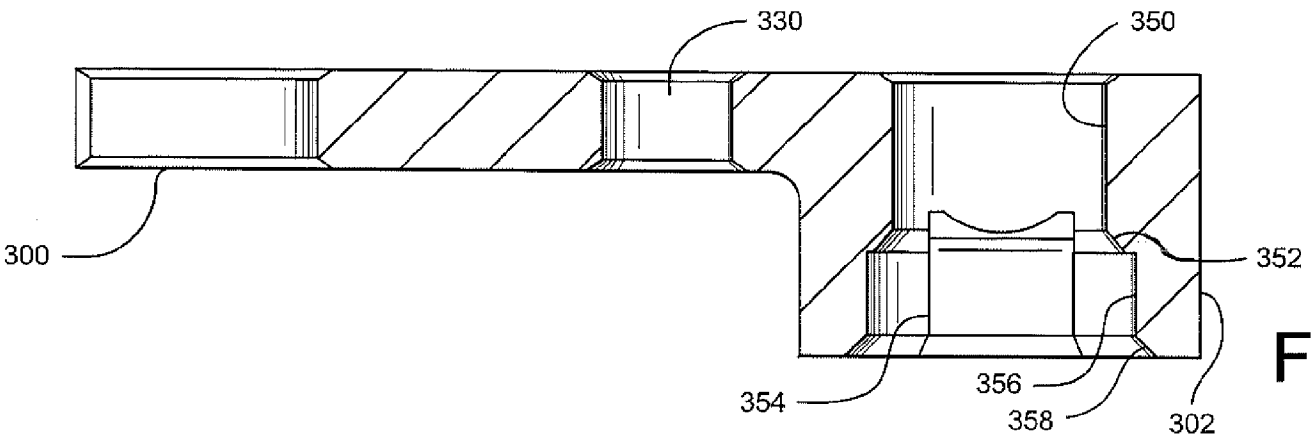
FIG. 10, is a cross sectional view of the input link of FIG. 9 depicting interface surfaces for interfacing with the output link.
Figure 11:
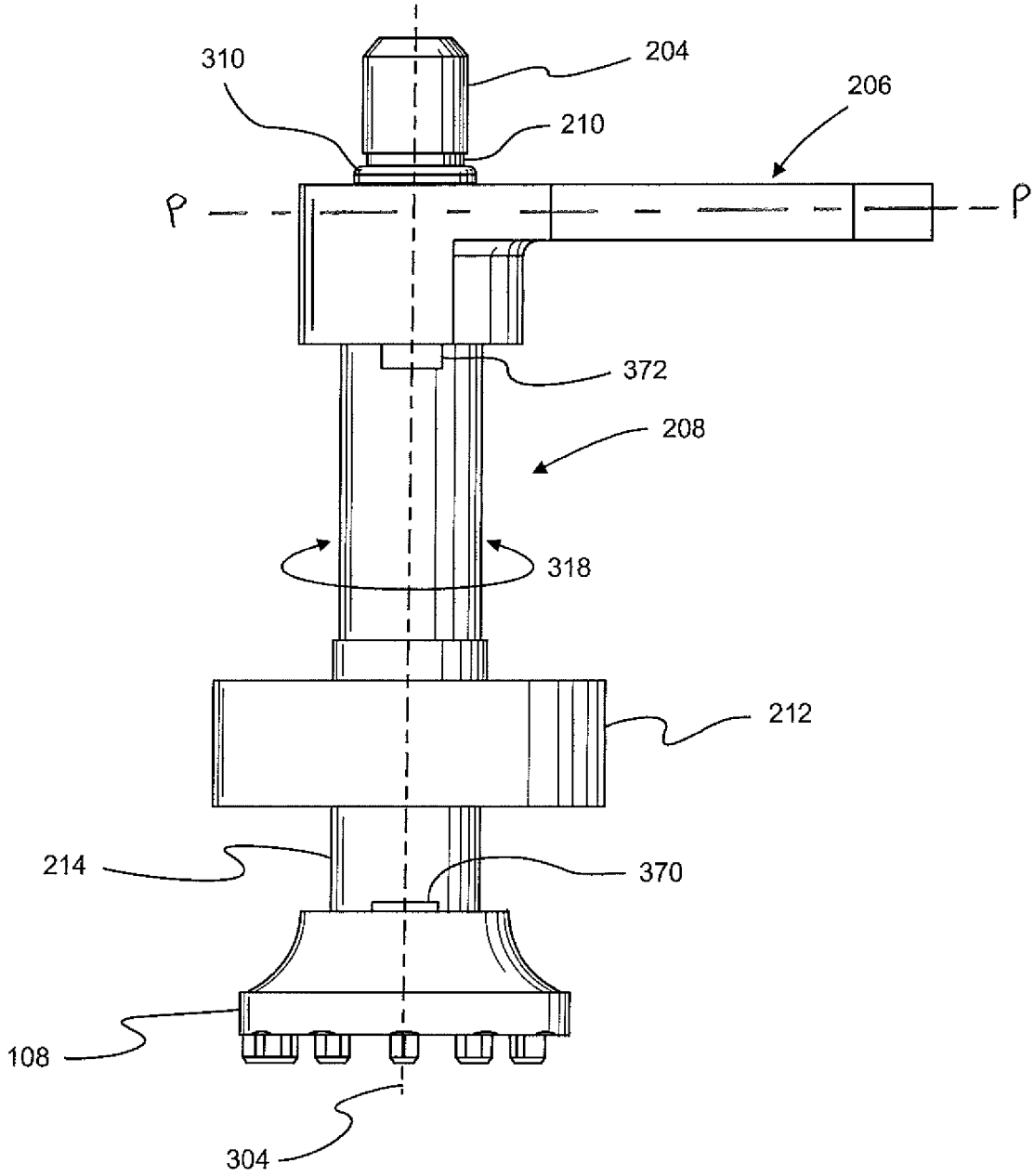
FIG. 11 is a plan view of the input link and the output link of the power tool of FIG. 1 in an assembled state depicting the second bearing, the tool mount and keys for coupling the tool mount to the output link and the output link to the input link.

Referring to FIGS. 9-11, details of the input link 206 are depicted. Shown in FIGS. 9-10 are holes 330, the collar 302 having the key slot 354, a small inner diameter 350, chamfers 352 and 358, a large inner diameter 356, and a plane designated by reference P-P. The holes 330 reduce the mass of the input link 206. The chamfers 352 and 358 cooperate with chamfers 314 and 310 to provide a locating function as the output link 208 is inserted into the input link 206 in the assembly process. The small inner diameter 350 is slightly larger than the shaft portion 312 of the output link 208. When assembled, the top portion 210 of the output link 208 extends above the collar 302 of the input link 206. FIG. 11 depicts the subassembly of the input link 206, the output link 208, the bearing 212, the tool mount 108, and keys 370 and 372. Particularly, FIG. 11 depicts a plan view of the approximate positions of the above components in the assembled state.

Figure 12:
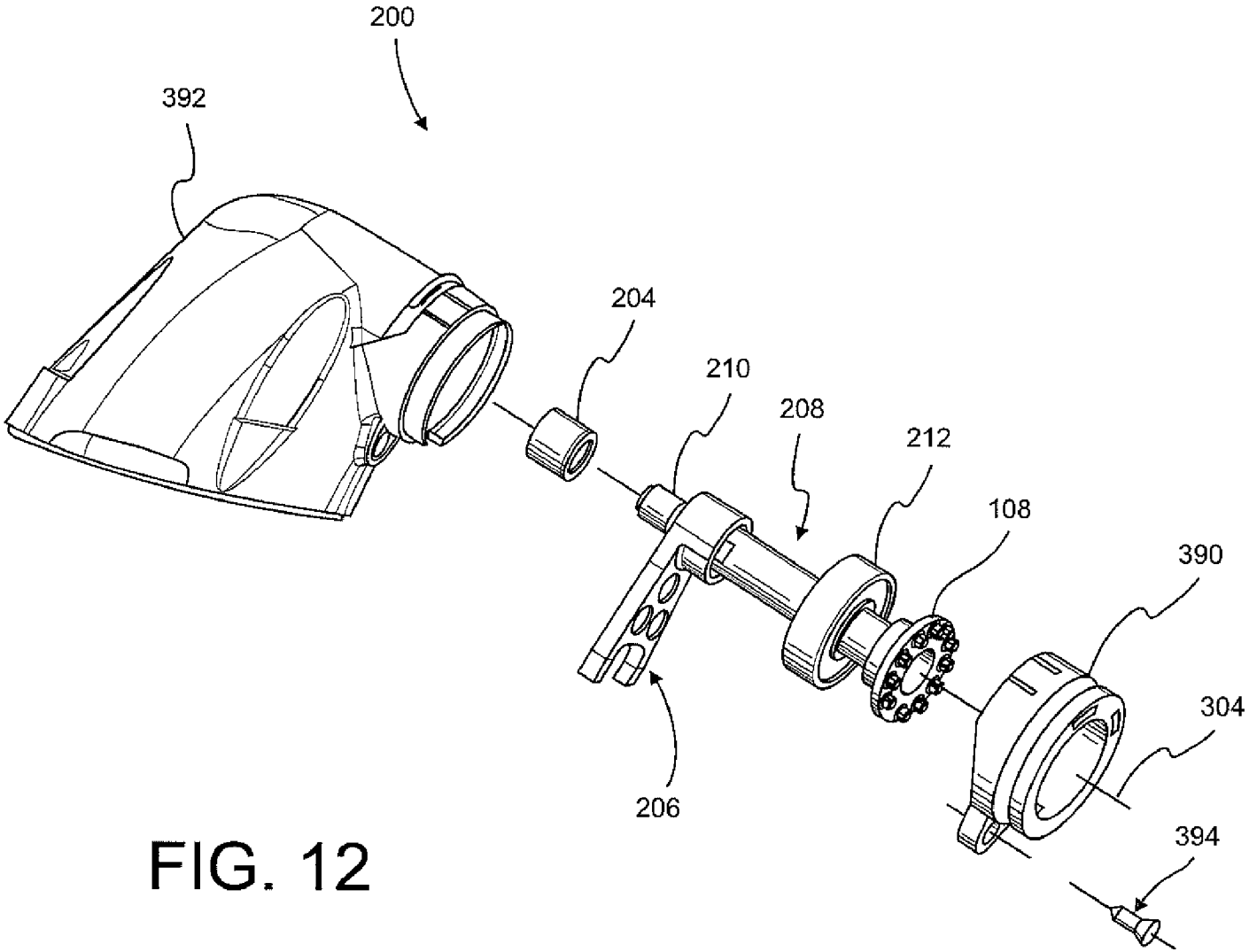
FIG. 12 is a partial exploded view of the head portion of the power tool of FIG. 1 depicting a bearing, a partially assembled input link, the output link, the second bearing, and the tool mount as well as a depicting a collar.

Referring to FIG. 12 an exploded view of some of the components of the head portion 200 is depicted. Shown in FIG. 12 are the bearing 204, the input link 206, the output link 208, the bearing 212, the tool mount 108, a collar 390, and a head portion 392 of the housing 114. The collar 390 is securely fastened to the head portion 392 of the housing 114 by at least one fastener 394. The top portion 210 of the output link 208 is received in the bearing 204 in a frictional fit manner.

Figure 14:
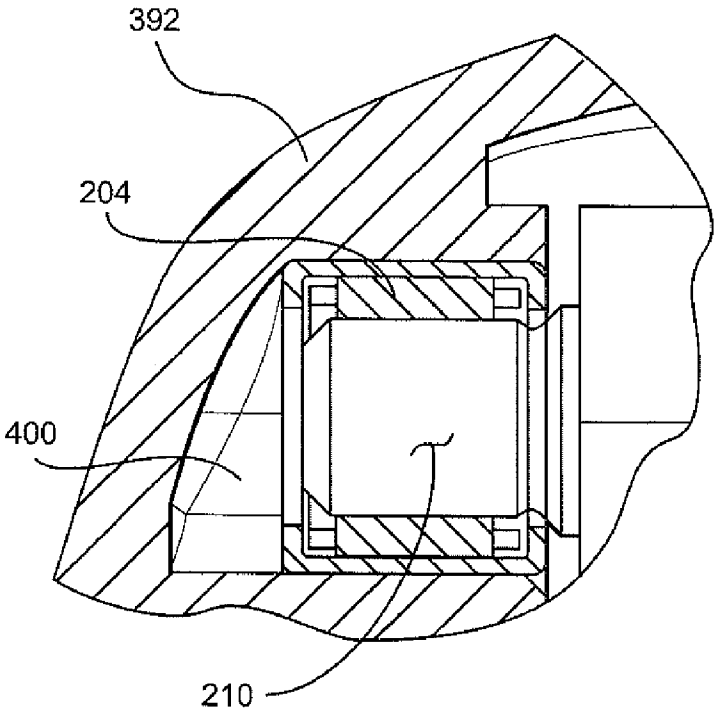
FIG. 14 is an enlarged partial cross sectional view of a portion of FIG. 13 depicting the bearing received inside the recess of the housing.
Figure 13:
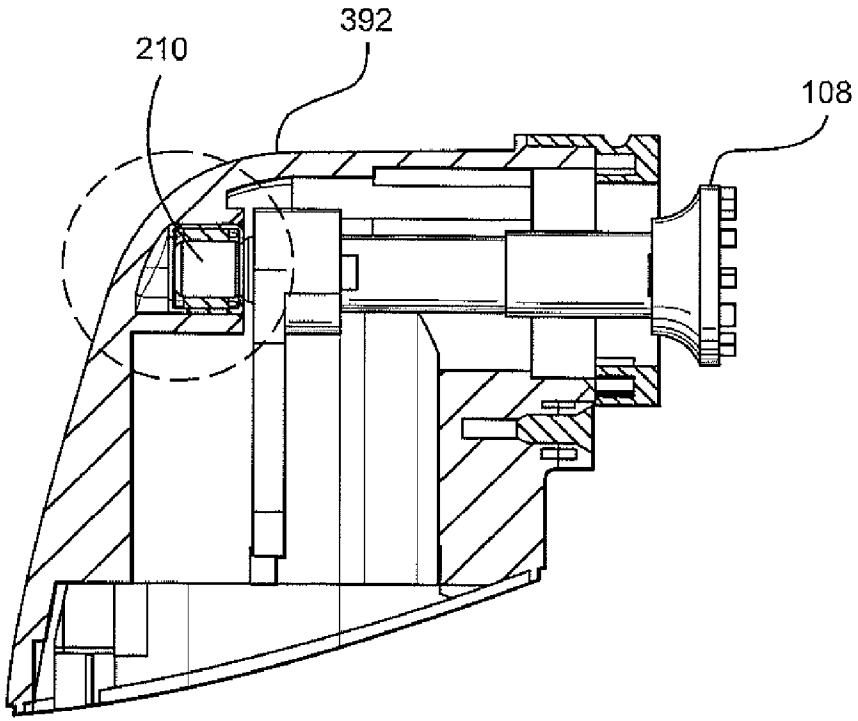
FIG. 13 is a partial cross sectional view of a head portion of the housing of the power tool of FIG. 1 including a recess.

Referring to FIGS. 13-14, partial cross sectional views of the head portion 392 of the housing 114 are depicted to reveal a bearing recess 400 provided in the housing 114. The bearing 204 is pressed into the bearing recess 400 in a frictional fit manner. Alternatively, the bearing 204 can be secured to the housing 114 by a fastener.

In operation, in reference to FIGS. 4-14, rotation of the motor output shaft 230 about the first axis 234 results in a body of the drive component 240, which includes the hub 244 and the counterbalance arrangement 242, to be rotated about the first axis 234. In response to the rotation of the body of the drive component 240, the output drive pin 216, which defines the second axis 236 having an offset from the first axis 234, is eccentrically driven. In response to the output drive pin 216 being eccentrically driven, the drive bearing 222, which is mounted on the drive bearing 222, is also eccentrically driven. In response to the drive bearing 222 being eccentrically driven, the input link 206 which has a bearing surface 300 that is in contact with the outer portion of the drive bearing 222 is caused to oscillate in a pseudo planar fashion in a plane depicted by the reference plane P-P, i.e., in and out of the page in FIG. 11. The oscillation of the input link 206 is translated to an oscillatory movement of the output link 208 by the keyed interface between the input and the output link. However, since movement of the output link 208 is restricted by the bearing 204, the output link 208 rotationally oscillates in the direction of arrows 318 (see FIGS. 8 and 11) about the axis 304. The rotational oscillation of the output link 208 translates to rotational oscillation of the tool mount 108, which translates to the oscillation of the tool 112.

While the present invention is illustrated by the description of exemplary processes and system components, and while the various processes and components have been described in considerable detail, applicant does not intend to restrict or in any way limit the scope of the appended claims to such detail. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

The invention claimed is:

1. A power tool, comprising:

a housing;

a motor having a motor output shaft and located within said housing, said motor being configured to rotate said motor output shaft about a first axis;

a drive component having (i) a body attached to said motor output shaft, and (ii) an output drive pin attached to said body, said output drive pin defining a second axis which is offset from said first axis, said body being caused to rotate about said first axis in response to rotation of said motor output shaft about said first axis, and said output drive pin being caused to be eccentrically driven in response to rotation of said body about said first axis, and further said body having a hub and a counterbalance arrangement attached to said hub, said counterbalance arrangement being positioned and configured to offset forces generated by said output drive pin when eccentrically driven;

a hub bearing structure located within said housing and including a bearing in which said hub of the drive component is received;

a linkage coupled to said output drive pin and configured to oscillate in response to said output drive pin being eccentrically driven; and a tool mount configured to oscillate in response to oscillation of said linkage;

wherein said counterbalance arrangement is located entirely between said bearing structure and said motor;

wherein said hub includes a first end portion and a second end portion, wherein said output drive pin extends from said first end portion, and wherein said counterbalance arrangement includes:

a first counterbalance structure extending radially from said second end portion of said hub, and a second counterbalance structure extending radially from said second end portion of said hub.

2. The power tool of claim 1, wherein:

said second end portion of said hub defines a bore aligned with said first axis, and said motor output shaft is received within said bore.

3. The power tool of claim 1, wherein said first counterbalance structure is spaced apart from said second counterbalance structure.

4. The power tool of claim 3, wherein said first counterbalance structure and said second counterbalance structure are offset from each other along said first axis.

5. The power tool of claim 4, wherein:

said second axis is offset from said first axis by X inches, and 0.025 inches $<X<0.045$inches, said first counterbalance structure possesses a first weight of Y g mg, and $1.7<Y<3.2$, and said second counterbalance structure possesses a second weight of Z g mg, and $2.7<Z<5.1$.

6. The power tool of claim 1, further comprising a drive bearing mounted on said output drive pin, wherein:

said drive bearing is caused to be eccentrically driven in response to said output drive pin being eccentrically driven, and said linkage is caused to oscillate in response to said drive bearing being eccentrically driven.

7. The power tool of claim 6, wherein:

said linkage includes (i) an input link having a bearing surface positioned in contact with said drive bearing, and (ii) an output link on which said tool mount is supported, said input link is caused to oscillate in response to said drive bearing being eccentrically driven, said output link is caused to oscillate in response to oscillation of said input link, and said tool mount is caused to oscillate in response to oscillation of said output link.

8. The power tool of claim 7, wherein:

said output link is secured to said housing so as to be rotatable with respect to said housing about a third axis, and said output link oscillates about said third axis in response to oscillation of said input link.

9. The power tool of claim 8, further comprising a first bearing structure and a second bearing structure, wherein:

said housing defines a bearing recess for receiving said first bearing structure, said output link has a first end portion and a second end portion, said first bearing structure is positioned in said bearing recess in a friction fit manner, said first bearing structure supports said first end portion of said output link, and said second bearing structure supports said second end portion of said output link within said housing.

10. The power tool of claim 1, further comprising a tool secured to said tool mount, said tool being caused to oscillate in response to oscillation of said tool mount.

* * * * *

UNITED STATES PATENT AND TRADEMARK OFFICE

CERTIFICATE OF CORRECTION

PATENT NO. : 8,381,833 B2
APPLICATION NO. : 12/566442
DATED : February 26, 2013
INVENTOR(S) : Walter M. Bernardi It is certified that error appears in the above-identified patent and that said Letters Patent is hereby corrected as shown below:

In the claims:

Claim 5, line 5 (col. 8, line 11):

Replace "of Y g mg," with -- of Y g, --

Claim 5, line 7 (col. 8, line 13):

Replace "weight of Z g mg," with -- weight of Z g, --

Signed and Sealed this
Twenty-seventh Day of August, 2013

Teresa Stanek Rea
*Acting Director of the United States Patent and Trademark Office*